US008174454B2

(12) United States Patent
Mayer

(10) Patent No.: US 8,174,454 B2
(45) Date of Patent: May 8, 2012

(54) DUAL-BAND ANTENNA

(75) Inventor: Lukas W. Mayer, Vienna (AT)

(73) Assignee: Infineon Technologies AG (DE)

( * ) Notice: Subject to any disclaimer, the term of this patent is extended or adjusted under 35 U.S.C. 154(b) by 1095 days.

(21) Appl. No.: 11/745,385

(22) Filed: May 7, 2007

(65) Prior Publication Data

US 2008/0278391 A1 Nov. 13, 2008

(51) Int. Cl.
*H01Q 21/00* (2006.01)

(52) U.S. Cl. ..... 343/725; 343/728

(58) Field of Classification Search ..... 343/767, 343/769, 895; 340/572.1
See application file for complete search history.

(56) References Cited

U.S. PATENT DOCUMENTS

| | | | | |
|---|---|---|---|---|
| 4,032,921 | A | 6/1977 | Sikina, Jr. et al. | |
| 6,121,936 | A | 9/2000 | Hemming et al. | |
| 6,946,958 | B2 * | 9/2005 | Gundlach et al. | 340/539.21 |
| 7,158,033 | B2 * | 1/2007 | Forster | 340/572.1 |
| 7,298,343 | B2 * | 11/2007 | Forster et al. | 343/767 |
| 2001/0050651 | A1 * | 12/2001 | Grangeat et al. | 343/767 |
| 2002/0000944 | A1 | 1/2002 | Sabet et al. | |
| 2005/0093677 | A1 * | 5/2005 | Forster et al. | 340/10.1 |
| 2006/0244676 | A1 * | 11/2006 | Uesaka | 343/895 |

FOREIGN PATENT DOCUMENTS

| | | |
|---|---|---|
| EP | 1336158 | 8/2003 |

OTHER PUBLICATIONS

Leong, K.S., et al., "Dual-frequency antenna design for RFID application," International Technical Conference on Circuits/Systems, Computers and Communications, Jul. 2006.

* cited by examiner

*Primary Examiner* — Jacob Y Choi
*Assistant Examiner* — Kyana R McCain
(74) *Attorney, Agent, or Firm* — Dickstein Shapiro LLP

(57) ABSTRACT

Dual-band antenna including a shorted loop slot antenna and a spiral antenna.

33 Claims, 3 Drawing Sheets

DUAL-BAND ANTENNA

FIELD OF THE INVENTION

The invention relates to a dual-band antenna.

BACKGROUND OF THE INVENTION

Dual-band antennas allow the use of frequencies in different bands. In contactless data storage media, such as radio frequency identification (RFID) tags, different frequency bands can be used to achieve optimum operation under different ambient conditions. Frequencies in the ultra-high-frequency (UHF) band of 300 MHz to 3 GHz allow a higher read range but are easily absorbed by liquids such as water. Frequencies in the high-frequency (HF) band between 3 MHz to 30 MHz are better able to penetrate water and other dielectric and lossy materials but have a shorter read range. The combination of a UHF band antenna with a HF band antenna allows to use the advantages of each frequency band. Further, a dual-band antenna allows more flexibility since it can operate in both frequency bands. However, a challenge in designing dual-band antennas is to minimize the mutual interference between the individual antennas.

BRIEF DESCRIPTION OF THE DRAWINGS

The invention will be explained in more detail below using exemplary embodiments and with the aid of the figures.

DETAILED DESCRIPTION OF THE INVENTION

Figure 1:
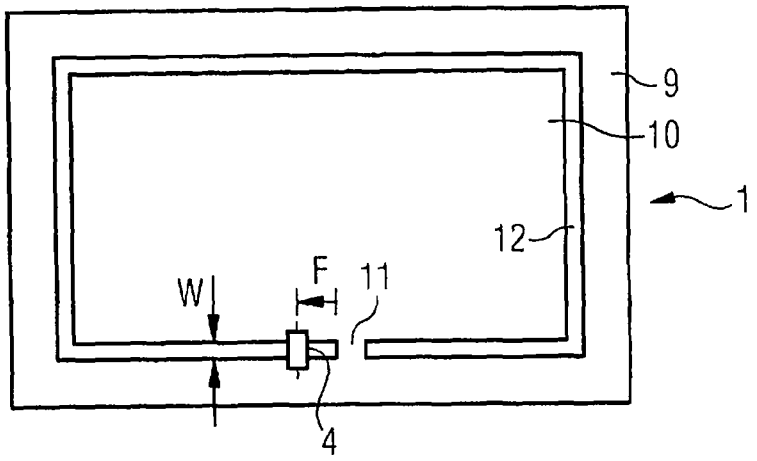
FIG. 1 shows an embodiment of a shorted loop slot antenna.

The invention provides a dual-band antenna comprising a shorted loop slot antenna and a spiral antenna. The antennas are combined to provide the advantages of each antenna type. Since the antennas have similar geometrical structures, the interference between the two antennas is minimal.

In an embodiment, the shorted loop slot antenna has a resonance frequency which is two orders of magnitude higher than a resonance frequency of the spiral antenna. The ratio of the frequencies of about 1 to 100 can be used to select electric paths by means of capacitors.

In an embodiment, the shorted loop slot antenna is an ultra-high-frequency (UHF) band antenna. UHF band antennas have a high reading range and high data transmission rate.

In an embodiment, the shorted loop slot antenna has a resonance frequency lying between 860 MHz and 960 MHz. The frequency range belongs to the industrial-scientific-medical (ISM) band which can be used for contactless data transmission, such as in radio frequency identification tags or contactless smart cards.

In an embodiment, the spiral antenna is a high-frequency (HF) band antenna. HF band antennas are less sensitive to the presence of water and other lossy materials.

In an embodiment, the spiral antenna has a resonance frequency of 13.56 MHz. The frequency of 13.56 MHz is also in the ISM band and is free for use.

In an embodiment, the dual-band antenna comprises a non-conducting carrier with a top side and a bottom side, metallizations on the top side of the carrier and metallizations on the bottom side of the carrier. The shorted loop slot antenna and the spiral antenna are formed in the metallizations on the carrier.

In an embodiment, the carrier has a thickness smaller than 100 μm. The carrier is thin enough to be flexible and can be used as a label for RFID tags for product identification. Further, the thickness allows capacitors to be implemented using the carrier and the metallizations on its top and bottom side.

In an embodiment, the carrier has dimensions smaller than 71 mm×44 mm. The dual-band antenna is thus smaller than a credit card, which allows for the application of the dual-band antenna to smaller items.

In an embodiment, the shorted loop slot antenna comprises an outer ring and a plate surrounded by the outer ring to form a loop slot in the metallizations on the top side. The length of the loop slot determines the frequency of the dual-band antenna and is approximately $\lambda/2$, with $\lambda$ being the wavelength of the resonance frequency.

In an embodiment, the plate and the outer ring are electrically connected. The electrical connection causes a reflection of electromagnetic waves so that the loop slot acts as a resonator at a specific frequency.

In an embodiment, the plate comprises a cut-out to form an inner loop. The cut-out in the plate is necessary to allow a magnetic flux to pass through a spiral antenna arranged outside the shorted loop slot antenna without blocking it by the metallization. Further, the cut-out reduces eddy currents flowing in the shorted loops of the antenna when the dual-band antenna is subjected to HF-frequencies.

In an embodiment, a bypass strip couples a side of the inner ring to an opposite side of the inner ring. The bypass strip conducts surface currents which were previously present in the plate without the cut-out and preserves the shorted loop slot antenna characteristics.

In an embodiment, the bypass strip is coupled by means of capacitors which conduct at ultra-high-frequencies (UHF) and do not conduct at high-frequencies (HF). The capacitors comprise a first metallization on the bottom side of the carrier which extends at least over the metallization of one side of the inner ring to the metallization of the opposite side of the inner ring.

In an embodiment, the inner ring comprises a non-conducting gap cutting through the inner ring.

In an embodiment, the dual-band antenna comprises a second metallization on the bottom side of the carrier which extends at least across the gap of the inner ring. The second metallization, the carrier and the metallization on each side of the gap in the inner ring form two capacitors. Each capacitor has a capacitance so that ultra-high-frequencies (UHF) are conducted and high-frequencies (HF) are not conducted across the gap in the inner ring.

In an embodiment, the outer ring comprises a non-conducting gap cutting through the outer ring.

In an embodiment, the dual-band antenna comprises a third metallization on the bottom side of the carrier which extends at least across the gap in the outer ring. The third metallization, the carrier and the metallization on each side of the gap in the outer ring form two capacitors, each having a capacitance so that ultra-high-frequencies (UHF) are conducted and high-frequencies (HF) are not conducted across the gap in the outer ring. The first, second and third metallization together with the gaps in the inner and outer ring are used for combining the high-frequency (HF) spiral antenna with the ultra-high-frequency (UHF) shorted loop slot antenna. The resulting capacitors conduct only at ultra-high-frequencies (UHF) and present an open circuit for high-frequencies (HF) so that the inner and outer ring of the shorted loop slot antenna can be used as two turns of conductors for the spiral antenna without affecting the shorted loop slot antenna characteristic.

In an embodiment, the resonance frequency of the shorted loop slot antenna is determined by the loop slot length. The resonance frequency can be chosen to be, for example, 868 MHz.

In an embodiment, the input impedance of the shorted loop slot antenna is determined by the loop slot length. Since an electronic chip is usually capacitive, it is necessary for the shorted loop slot antenna to have an inductive behavior in order to achieve power matching. This is achieved by setting the resonance frequency of the shorted loop slot antenna above the desired working frequency.

In an embodiment, the input impedance of the shorted loop slot antenna is determined by a feed position along the loop slot. The feed position is a position along the loop slot at which an electronic chip is connected to the antenna. By varying the position at which the electronic chip is connected to, the input impedance can be adjusted.

In an embodiment, the input impedance of the shorted loop slot antenna is determined by a width of the loop slot.

In an embodiment, the spiral antenna is formed in the metallization on the top side and comprises turns of conductor arranged around the outer ring of the shorted loop slot antenna or comprises turns of conductor arranged inside the inner ring of the shorted loop slot antenna. Since the spiral antenna consists of loops of conductors and the outer ring as well as the inner ring also are in the form of loops, only minimal interference between the spiral antenna and the shorted loop slot antenna occurs. The spiral antenna is placed outside the shorted loop slot antenna so that the area through which magnetic flux passes is maximal. If it is placed inside the shorted loop slot antenna the size of the dual-band antenna can be further reduced.

In an embodiment, additional turns of conductor for the spiral antenna comprise the outer ring and the inner ring of the shorted loop slot antenna. The outer ring and the inner ring of the shorted loop slot antenna are thus reused as additional turns for the spiral antenna. The coupling and decoupling of the inner ring and the outer ring is achieved by providing capacitors which conduct at ultra-high-frequencies (UHF) and do not conduct at high-frequencies (HF).

In an embodiment, the resonance frequency of the spiral antenna is determined by the number of conductor turns of the spiral antenna. The resonance frequency is given by the inductance and the capacitance of the spiral antenna. The inductance increases with the number of conductor turns.

In an embodiment, the antenna comprises fourth and fifth metallizations on the bottom side of the carrier for altering the capacitance of the spiral antenna to tune the center frequency of the spiral antenna.

In an embodiment, a quality factor of the spiral antenna is determined by the conductor width of its conductor turns. A smaller conductor width leads to higher losses and to a lower quality factor. The wider bandwidth associated with a lower quality factor provides practical robustness to detuning effects.

In an embodiment, an electronic chip is coupled in parallel to the shorted loop slot antenna and the spiral antenna. The electronic chip connected to the dual-band antenna thus only requires one connection and no switching between the high-frequency and ultra-high-frequency antenna is necessary.

In an embodiment, the electronic chip is coupled to the inner ring and the outer ring. The electronic chip can thus be supplied with electrical power by the shorted loop slot antenna.

In an embodiment, the electronic chip is electrically connected to sixth and seventh metallizations on the bottom side of the carrier.

In an embodiment, the first metallization, the second metallization, the fourth metallization and the sixth metallization are electrically connected.

In an embodiment, the third metallization, the fifth metallization and the seventh metallization are electrically connected. Since the first, second, third, fourth, fifth, sixth and seventh metallizations perform a similar function that is to provide a capacitance, they can be combined to form single metal pads.

In an embodiment, the electronic chip is electrically connected to the inner ring by means of a first via. The inner ring is not only connected to the shorted loop slot antenna but also forms a turn of the spiral antenna so that the chip can also be supplied by the spiral antenna.

In an embodiment, the electronic chip is electrically connected to an outermost turn of the spiral antenna by means of a second via.

In an embodiment, at least one of the inner ring, the outer ring and the turns of conductors have a rectangular, circular or elliptical shape.

The invention further provides for the use of the dual-band antenna in a contactless data storage medium. The power supply and the data transfer can thus be achieved contactlessly in two different frequency bands.

In an embodiment, the contactless data storage medium is a radio frequency identification tag or a smart card.

FIG. 1 shows an embodiment of a shorted loop slot antenna 1, comprising a conducting outer ring 9 and a conducting plate 10. A loop slot 12 is formed between the outer ring 9 and the plate 10. The length of the loop slot 12 determines the resonance frequency of the shorted loop slot antenna 1 and is approximately $\lambda/2$, where $\lambda$ is the wavelength of the resonance frequency. A short 11 electrically connects the outer ring 9 to the plate 10 imposing boundary conditions on the electromagnetic waves in the loop slot 12 so that a resonator is achieved. An electronic chip 4 is connected with one terminal to the plate 10 and with the other terminal to the outer ring 9. To achieve power matching, the feed position F of the electronic chip 4 and the width W of the loop slot 12 can be adjusted. Further, since the electronic chip 4 usually shows capacitive behavior, the loop slot length can be decreased so that the antenna 1 shows a slightly increased resonance frequency with inductive behavior.

Figure 2:
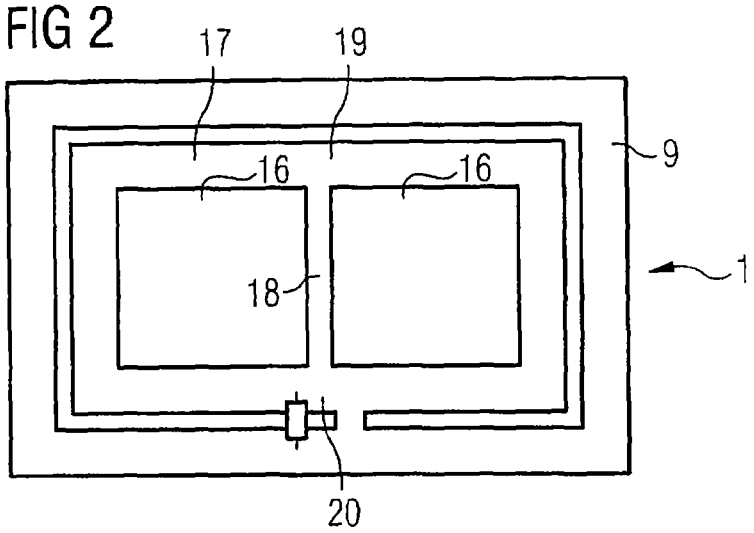
FIG. 2 shows a modified embodiment of a shorted loop slot antenna having a cut-out and a bypass strip.
Figure 5:
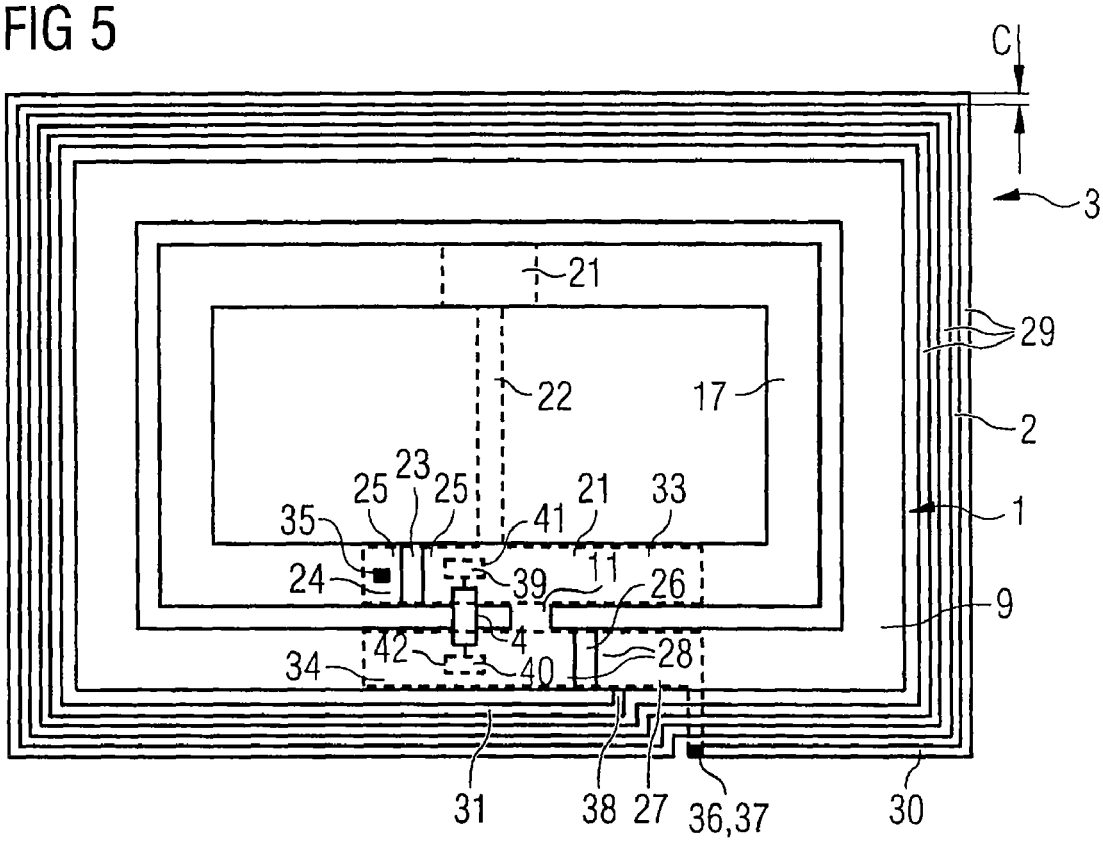
FIG. 5 shows an embodiment of a dual-band antenna with a shorted loop slot antenna and a spiral antenna.

FIG. 2 shows a modified embodiment of the shorted loop slot antenna 1 of FIG. 1. Same reference signs refer to the same features and will not be described again. The large conducting plate 10 in FIG. 1 prevents magnetic flux flowing through a spiral antenna 2, which is shown in FIG. 5. Further, the spiral antenna 2 causes eddy currents to flow inside the plate 10. A cut-out 16 from the metal plate 10 reduces the eddy currents and allows more flux to flow through the spiral antenna 2. The plate 10 with the cut-out 16 forms an inner ring 17. A bypass strip 18 from one side 19 of the inner ring to an opposite side 20 of the inner ring is provided to allow surface currents present in the plate 10 at UHF frequencies to flow in order to preserve the shorted loop slot antenna characteristic.

Figure 3:
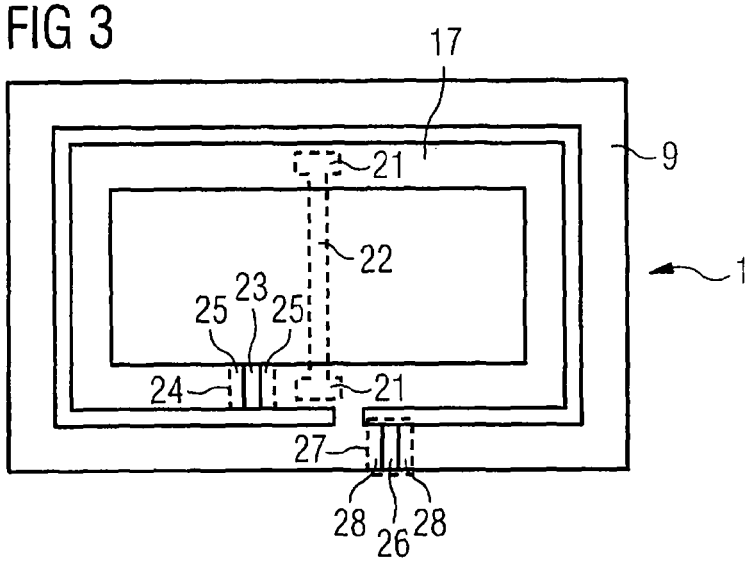
FIG. 3 shows a modified embodiment of a shorted loop slot antenna for combination with a spiral antenna.

FIG. 3 shows an embodiment that is based on a modification of the shorted loop slot antenna in FIG. 2. The embodiment allows combination of the shorted loop slot antenna 1 and the spiral antenna 2 and increases the efficiency of the spiral antenna 2. When HF frequencies are applied to the spiral antenna 2, currents are induced in the inner ring 17 and the outer ring 9 which push the magnetic field to the outside and so reduce the magnetic flux in the spiral antenna 2. Further, it is desired to reuse the inner ring 17 and the outer ring 9 as additional turns of the spiral antenna 2.

To achieve the above goal, the inner ring 17 and the outer ring 9 are provided with non-conducting gaps 23 and 26, respectively. The shorted loop slot antenna 1 is formed in metallizations on the top side 6 of a carrier 5. On a bottom side 7 of the carrier 5, a second metallization 24 and a third metallization 27 are provided which respectively extend across the gap 23 in the inner ring 17 and the gap 26 in the outer ring 9. Similarly, the bypass strip 18 of the FIG. 2 is no longer electrically connected to the side 19 and the opposite side 20 of the inner ring 17 but is formed as a first metallization 22 on the bottom side 7 of the carrier 5. The metallizations on the bottom side of the carrier are shown with dotted lines.

The first metallization 21, the second metallization 24, and the third metallization 27 on the bottom side 7 and the inner ring 17 and the outer ring 9 on the top side 6 of the carrier 5 form capacitor pairs 21, 25 and 28. The shorted loop slot antenna 1 is designed to operate in the ultra-high-frequency (UHF) range while the spiral antenna 2 is designed for use in the high-frequency (HF) range. The operation frequencies of the two antennas 1, 2 differ from each other by two orders of magnitude. It is therefore possible to use capacitors which conduct at the ultra-high-frequency (UHF) and do not conduct at the high-frequency (HF). The terms "conduct" and "non-conduct" are used in a relative sense to each other, as a capacitor usually conducts any alternating currents. If the frequencies are related to each other by a ratio of 1:100, then the conductance of the capacitor at the higher frequency is 100% while at the lower frequency it is relatively non-conductive at 1%.

At ultra-high-frequencies (UHF), the capacitors 21, 25 and 28 conduct currents so that the shorted loop slot antenna 1 in FIG. 3 functions in the same way as the shorted loop slot antenna 1 of FIG. 2 by shorting the gap 23 in the inner ring and the gap 26 in the outer ring, as well as coupling the bypass strip from the side 19 of the inner ring 17 to the opposite side 20 of the inner ring. At high-frequencies (HF), the capacitors 21, 25 and 28 do not conduct so that the outer ring 9 and the inner ring 17 can be used as additional turns of conductors for the spiral antenna 2, as is described together with FIG. 5.

Figure 4:
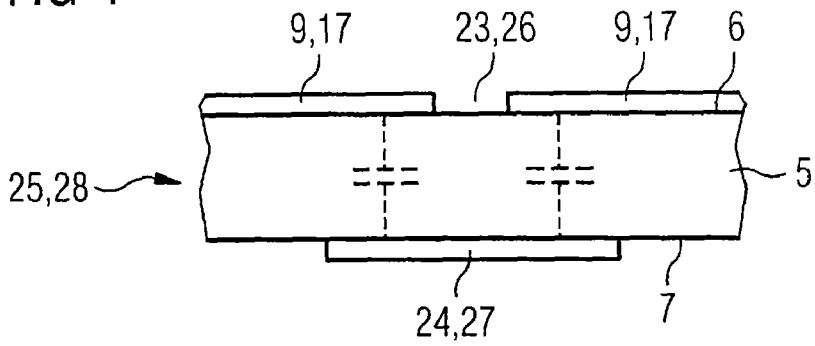
FIG. 4 shows an embodiment of a capacitor.

FIG. 4 is used to illustrate the capacitors 25 and 28 in the inner ring 17 and the outer ring 9 of FIG. 3. A carrier 5 has a top side 6 and a bottom side 7 which are provided with metallizations. For the inner ring capacitor 25, the top side metallization is the inner ring 17 which is opened by a non-conducting gap 23, while the bottom side metallization is the second metallization 24. For the outer ring capacitor 28, the top metallization is the outer ring 9 with a non-conducting gap 26 cutting through the outer ring 9 and the bottom metallization is the third metallization 27. The metallizations on the top and the bottom side 6, 7 of the carrier 5 form parallel plate capacitors. The capacitors are dimensioned such that ultra-high-frequencies (UHF) are passed through them and high-frequencies (HF) are blocked. At ultra-high-frequencies (UHF), currents flow from the left top metallization 9, 17 through the carrier 5 to the bottom metallization 24, 27 and back through the carrier 5 to the right top metallization 9, 17. The function of the gaps 23 and 26 are thus bypassed by the capacitors 25 and 28 at ultra-high-frequencies (UHF). The dimensioning of the capacitors is influenced by the area of the metallizations on the top side 6 and the bottom side 7, the distance between the metallizations on the top side 6 and the bottom side 7 and the electric permittivity of the carrier 5. As an example, the thickness of the carrier 5 is chosen to be 25 μm and the material is a polyimide, such as ESPANEX MB FRG-Z. A person skilled in the art knows how to adjust the dimensions of the first, second and third metallizations 22, 24 and 27 and to determine the thickness of the carrier 5 and is able to use different materials for the carrier 5 in order to achieve the desired capacitances of the capacitors 21, 25 and 28. FIGS. 3 and 5 show different dimensions of the first, second and third metallizations 21, 24 and 27 as an illustration. The capacitive coupling using the first metallization 22 for the bypass strip is achieved in a similar manner as described above.

Figure 6:
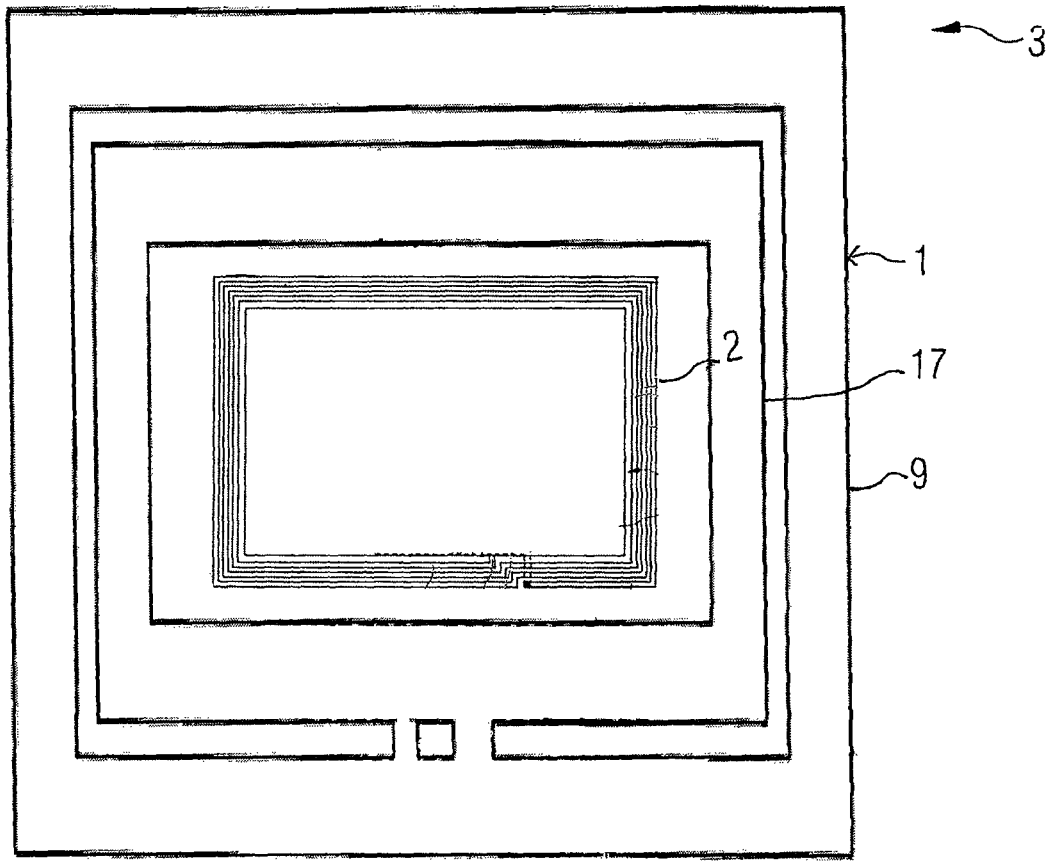
FIG. 6 shows another embodiment of a dual-band antenna with a shorted loop slot antenna and a spiral antenna.

FIG. 5 shows an embodiment of the dual-band antenna comprising a shorted loop slot antenna 1 and a spiral antenna 2. The shorted loop slot antenna 1 is the same as shown in FIG. 3 with additional modifications to the metallizations on the bottom layer 7. The spiral antenna 2 consists of turns of conductors 29 which are arranged in a spiral manner, starting from an outermost conductor turn 30 and ending at an innermost conductor turn 31. The spiral antenna 2 has a start 37 at the outermost conductor 30 and an end 38 at the innermost conductor 31 at which the induced voltage can be accessed. The number of conductor turns 29 shown is three. However, a different number of conductor turns 29 may be used. The number of conductor turns 29 determines the resonance frequency of the spiral antenna 2 and give it an inductive behavior. More conductor turns 29 lead to a higher induced voltage in the spiral antenna 2. The width C of the conductor turns 29 can be used to set the quality factor of the spiral antenna 2. To counter detuning effects, a lower gain and a wider bandwidth of the spiral antenna 2 can be used. The spiral antenna 2 is arranged around the shorted loop slot antenna 1 so that more magnetic flux passes through the conductor turns 29 in order to induce a higher voltage in the spiral antenna 2. Alternatively, as shown in FIG. 6, the spiral antenna 2 can also be arranged inside the inner ring 17 of the shorted loop slot antenna 1, which reduces the size of the dual-band antenna. FIG. 6, for the sake of simplicity, does not show many of the detailed features of FIG. 5, but it is appreciated by those of ordinary skill that this embodiment also includes these features. The similar geometrical loop structure of the conductor turns 29 and the rings 9 and 17 leads to minimal mutual interference in the antenna characteristics when arranging them together on a single carrier 5. The shorted loop slot antenna 1 and the spiral antenna 2 are shown with rectangular loop metallizations, which is especially useful when applying the dual-band antenna to smart cards having a credit card sized carrier. The shorted loop slot antenna 1 and the spiral antenna 2 can also be designed using circularly or elliptically shaped metallizations.

The operation of the dual-band antenna is as follows. At high-frequencies (HF), for example at 13.56 MHz, the capacitors 21, 25 and 28 are non-conducting so that the gaps 23 in the inner ring and 26 in the outer ring are not bypassed and the bypass strip is not connected. The end 38 of the innermost conductor 31 is connected to one end of the outer ring 9. The other end of the outer ring 9 is connected to one end of the inner ring 17 by means of the short 11. The other end of the inner ring 17 is connected to a first via 35 which passes through the carrier 5 to the bottom side 7. A metallization on the bottom side 7 connects the first via 35 and one terminal of the electronic chip 4. The outer ring 9 and the inner ring 17 thus function as additional conductor turns for the spiral antenna 2. The start 37 of the outermost conductor turn 30 is connected to a second via 36 leading through the carrier 5 to a metallization on the bottom side 7 of the carrier 5 which is connected to the other terminal of the electronic chip 4. At high-frequencies, the dual-band antenna acts like a spiral antenna with the number of conductor turns increased by two due to the inner ring 17 and the outer 9.

At ultra-high-frequencies (UHF), such as, for example, 868 MHz, the capacitors 21, 25 and 28 conduct so that the dual-band antenna acts like the shorted loop slot antenna 1 shown in FIG. 2. In contrast to FIG. 2 the electronic chip 4 is located on the bottom side 7 of the carrier 5. One terminal of the electronic chip 4 is electrically coupled to the inner ring 17 and the other terminal to the outer ring 9 by means of capacitors 39 and 40. The capacitors 39 and 40 are formed by the sixth and seventh metallizations 41 and 42 on the bottom side 7, the carrier 5 and the metallizations of the inner ring 17 and the outer ring 9 on the top side 6 and conduct at UHF-frequencies and do not conduct at HF-frequencies. In principle the electronic chip 4 can also be coupled by the metallizations 24 and 27 over the gaps but providing extra capacitors 39 and 40 allows choosing the electric chip position independently from the position of the gap capacitors, for example for the purpose of power matching of the electronic chip 4 to the shorted loop slot antenna 1. The start 37 of the outermost conductor turn 30 and the end 38 of the innermost conductor turn 31 of the spiral antenna 2 are shorted by the second via 36 and the conducting capacitor between the bottom layer metallization and the outer ring 9.

In FIG. 5, the metallizations on the bottom side 7 of the carrier 5 of FIG. 3 have been modified. The first metallization 22 for the bypass strip is connected to the second metallization 24 of the inner gap capacitors 25 and to the sixth metallization 41 connected to the electronic chip 4. Further, the metallization shown in FIG. 5 is larger as an additional fourth metallization 33 has been added. The fourth metallization 33 is used to add capacitance to the spiral antenna 2 when operating at high-frequencies (HF) for adjusting the resonance frequency of the spiral antenna 2. Similarly, the third metallization 27 of the outer gap capacitors 28 is connected to the seventh metallization 42 connected to the electronic chip 4 and is combined with a fifth metallization 34 to add capacitance to the spiral antenna 2 for adjusting its resonance frequency.

The dual-band antenna is used to provide a contactless data storage medium 3 with electrical energy and data. The contactless data storage medium 3 can be an RFID tag which has an attaching means, such as an adhesive tape for applying it to a product that is to be identified. The flexible carrier 5 can be attached to a multitude of differently sized objects. If the dual-band antenna is used in a smart card, it can be fixed on a thicker carrier for protection.

The invention provides for a small and flexible dual-band antenna which has the advantage of a very low level of interference between the antennas and allows the reuse of the shorted loop slot antenna 1 as conductor turns of a spiral antenna 2. The input impedance of both antennas can be adjusted as well as the quality factor and the resonance frequency by simple geometric variations in the metallizations.

What is claimed is:

1. A dual-band antenna, comprising a shorted loop slot antenna, and a spiral antenna, wherein the shorted loop slot antenna comprises an outer ring and a plate surrounded by the outer ring to form a loop slot in metallizations on a top side of a non-conducting carrier, and the plate and the outer ring are electrically connected, wherein the plate comprises a cut-out to form an inner ring, there are metallizations on a bottom side of the carrier, the shorted loop slot antenna is an ultra-high-frequency (UHF) band antenna, the spiral antenna is a high-frequency (HF) band antenna, and the shorted loop slot antenna has a resonance frequency which is two orders of magnitude higher than a resonance frequency of the spiral antenna.

2. The dual-band antenna of claim 1, wherein the shorted loop slot antenna has a resonance frequency lying between 860 MHz and 960 MHz.

3. The dual-band antenna of claim 1, wherein the spiral antenna has a resonance frequency of 13.56 MHz.

4. The dual-band antenna of claim 1, wherein the carrier has a thickness smaller than 100 μm.

5. The dual-band antenna of claim 4, wherein the carrier has dimensions smaller than 71 mm×44 mm.

6. The dual-band antenna of claim 1, further comprising a short electrically connecting the outer ring to the plate.

7. The dual-band antenna of claim 1, wherein a bypass strip couples a side of the inner ring to an opposite side of the inner ring.

8. The dual-band antenna of claim 7, wherein the bypass strip is coupled by capacitors which conduct at ultra-high-frequencies (UHF) and do not conduct at high-frequencies (HF), the capacitors comprising a first metallization on the bottom side of the carrier which extends at least over the metallization of one side of the inner ring to the metallization of the opposite side of the inner ring.

9. The dual-band antenna of claim 8, wherein the inner ring comprises a non-conducting gap cutting through the inner ring.

10. The dual-band antenna of claim 9, further comprising a second metallization on the bottom side of the carrier which extends at least across the non-conducting gap in the inner ring, wherein the second metallization, the carrier and the metallization on each side of the non-conducting gap in the inner ring form two capacitors, each having a capacitance so that ultra-high-frequencies (UHF) are conducted and high-frequencies (HF) are not conducted across the gap in the inner ring.

11. The dual-band antenna of claim 10, wherein the outer ring comprises a non-conducting gap cutting through the outer ring.

12. The dual-band antenna of claim 11, further comprising a third metallization on the bottom side of the carrier which extends at least across the non-conducting gap in the outer ring, wherein the third metallization, the carrier and the metallization on each side of the gap in the outer ring form two capacitors, each having a capacitance so that ultra-high-frequencies (UHF) are conducted and high-frequencies (HF) are not conducted across the gap in the outer ring.

13. The dual-band antenna of claim 12, wherein the resonance frequency of the shorted loop slot antenna is determined by a loop slot length.

14. The dual-band antenna of claim 12, wherein the input impedance of the shorted loop slot antenna is determined by a loop slot length.

15. The dual-band antenna of claim 12, wherein the input impedance of the shorted loop slot antenna is determined by a feed position along the loop slot.

16. The dual-band antenna of claim 15, wherein the input impedance of the shorted loop slot antenna is determined by a width of the loop slot.

17. The dual-band antenna of claim 12, wherein the spiral antenna is formed in the metallization on the top side of the carrier and comprises turns of conductor arranged around the outer ring of the shorted loop slot antenna, or comprises turns of conductor arranged inside the inner ring of the shorted loop slot antenna.

18. The dual-band antenna of claim 17, wherein additional turns of conductor for the spiral antenna comprise the outer ring and the inner ring of the shorted loop slot antenna.

19. The dual-band antenna of claim 17, wherein the resonance frequency of the spiral antenna is determined by the number of conductor turns of the spiral antenna.

20. The dual-band antenna of claim 19, further comprising fourth and fifth metallizations on the bottom side of the carrier for altering the capacitance of the spiral antenna to tune the center frequency of the spiral antenna.

21. The dual-band antenna of claim 17, wherein a quality factor of the spiral antenna is determined by the conductor width of its conductor turns.

22. The dual-band antenna of claim 17, wherein at least one of the inner ring, the outer ring and the turns of conductors have a rectangular, circular or elliptical shape.

23. A contactless data storage medium comprising the dual-band antenna of claim 1.

24. The contactless data storage medium of claim 23, wherein the contactless data storage medium is a radio frequency identification tag or a smart card.

25. A dual-band antenna comprising a shorted loop slot antenna, and a spiral antenna, wherein an electronic chip is coupled in parallel to the shorted loop slot antenna and spiral antenna, and the electronic chip is coupled to an inner ring and an outer ring.

26. The dual-band antenna of claim 25, wherein the electronic chip is electrically connected to sixth and seventh metallizations on a bottom side of a non-conducting carrier.

27. The dual-band antenna of claim 26, further comprising:

the non-conducting carrier with a top side and a bottom side, wherein the shorted loop slot antenna comprises an outer ring and a plate surrounded by the outer ring, and the plate comprises a cut-out to form an inner ring;

a first metallization on the bottom side of the carrier which extends at least over metallization of one side of the inner ring to metallization of the opposite side of the inner ring;

a second metallization on the bottom side of the carrier which extends at least across a non-conducting gap in the inner ring; and fourth and fifth metallizations on the bottom side of the carrier for altering the capacitance of the spiral antenna to tune the center frequency of the spiral antenna, wherein the first metallization, the second metallization, the fourth metallization and the sixth metallization are electrically connected.

28. The dual-band antenna of claim 27, further comprising a third metallization on the bottom side of the carrier which extends at least across a nonconducting gap in the outer ring, wherein the third metallization, the fifth metallization and the seventh metallization are electrically connected.

29. The dual-band antenna of claim 28, wherein the electronic chip is electrically connected to the inner ring by means of a first via.

30. The dual-band antenna of claim 29, wherein the electronic chip is electrically connected to an outermost turn of the spiral antenna by means of a second via.

31. A dual-band antenna, comprising:

a shorted loop slot antenna comprising an inner ring and an outer ring, each ring comprising a non-conducting gap;

a spiral antenna comprising a plurality of conductor turns arranged around the outer ring of the shorted loop slot antenna or comprising a plurality of conductor turns arranged inside the inner ring of the shorted loop slot antenna; and a switch connected to the shorted loop slot antenna and the spiral antenna such that at a UHF frequency the gaps of inner ring and the outer ring are electrically shorted, and at a HF frequency the inner ring and the outer ring are connected in series to each other and in series to the plurality of conductor turns of the spiral antenna.

32. The antenna of claim 31, wherein the switch comprises capacitors conducting at the UHF frequency and non-conducting at the HF frequency.

33. A dual-band antenna, comprising:

a shorted loop slot antenna;

a spiral antenna; and a switching means for permitting the dual-band antenna to operate in the UHF ultra-high-frequency band and the HF high-frequency band.

* * * * *